United States Patent [19]

Silvia

[11] Patent Number: 4,974,514

[45] Date of Patent: Dec. 4, 1990

[54] EXPLOSIVE SAFETY JUNCTION

[75] Inventor: Denis A. Silvia, Aberdeen, Md.

[73] Assignee: The United States of America as represented by the Secretary of the Navy, Washington, D.C.

[21] Appl. No.: 305,677

[22] Filed: Sep. 25, 1981

[51] Int. Cl.[5] ..... F42D 1/04; F42D 3/10; F42C 19/08

[52] U.S. Cl. ..... 102/305; 102/75.9; 102/701

[58] Field of Search ..... 102/275.1, 275.2, 275.3, 102/275.4, 275.6, 275.7, 275.8, 275.9, 305, 701, 202, 202.1, 475, 215, 222, 221

[56] References Cited

U.S. PATENT DOCUMENTS

| | | | |
|---|---|---|---|
| 3,035,518 | 5/1962 | Coursen | 102/305 |
| 3,430,564 | 3/1969 | Silvia et al. | 102/275.9 |
| 3,496,868 | 2/1970 | Silvia et al. | 102/305 |
| 3,669,021 | 6/1972 | Spencer et al. | 12/275.9 X |
| 3,753,402 | 8/1973 | Menz et al. | 102/701 X |
| 3,768,409 | 10/1973 | Menz et al. | 102/275.9 |
| 3,820,461 | 2/1970 | Silvia | 102/305 |
| 3,973,499 | 8/1976 | Anderson et al. | 102/701 X |

*Primary Examiner*—David H. Brown

*Attorney, Agent, or Firm*—John D. Lewis; Kenneth E. Walden

[57] ABSTRACT

An explosive safety junction which can meet the high reliability and safety standards of conventional or nuclear weapon safing devices. The safety junction is an explosive logic device having an inlet trail which diverges into one or more tiers of safety trails and converges to form an outlet trail. The safety trails are crossed by a control trail which propagates a control detonation wave which severs the safety trails and prevents an input detonation wave from proceeding from the inlet trail to the outlet trail to detonate the weapon.

17 Claims, 3 Drawing Sheets

EXPLOSIVE SAFETY JUNCTION

BACKGROUND OF THE INVENTION

Many ordnance devices, such as projectiles, mines or bombs, require a fuze to detonate the device at the desired place and time. An important part of the fuze is the safety and arming device (S/A), which contains a group of explosive components called an explosive train. The explosive train may be in an out-of-line (safe) position Or in an in-line (armed) position. When in the safe position, accidental initiation of any of the elements of the explosive train must not lead to detonation of the weapon. Conversely, when in the armed position, initiation of the explosive train must always lead to detonation of the weapon.

Prior art methods of safe arming an explosive device consist of using mechanical devices or exploding bridgewire devices. The mechanical safe arming devices physically interpose a barrier between the detonator explosive charge and the main or primary charge of the weapon. Mechanical devices have several drawbacks in that environmental degradation over an extended storage period results in a high reliability failure rate. In addition, as weapon designs become more complex, the requirements placed on mechanical safe arming devices have resulted in mechanical mechanisms which are large, expensive, complex, and thus more unreliable.

Exploding bridgewire devices remove the primary explosive charge from the detonator. The bridgewire device initiates the main charge by providing a tremendous pulse of high voltage current to the bridgewire which causes the bridgewire to explode thus directly initiating a booster charge. Because the bridgewire detonator does not contain any primary explosive, the detonator may be connected directly to the main charge without the necessity of a mechanical safing mechanism. The drawback of the exploding bridgewire detonator is that it requires a very expensive power supply to provide the necessary current for exploding the bridgewire. The power supply must be safed to the same level of protection obtained by mechanical safe arming.

SUMMARY OF THE INVENTION

Accordingly, there is provided in the present invention an explosive safety junction which meets the extremely high reliability and safety standards of conventional and nuclear weapon safing devices. The explosive logic network of the safety junction can replace the unreliable mechanical devices used in conventional weapons and the very expensive exploding bridgewire mechanisms used in nuclear weapons.

The explosive safety junction is constructed as an explosive logic network having an inlet trail which carries a detonation wave from a detonator to the safety junction. The inlet trail diverges into two or more safety trails which in turn may diverge into multiple tiers of secondary safety trails. The secondary safety trails converge to reform the safety trails which in turn converge to form the outlet trail which carries the detonation wave or signal to the primary charge of the weapon. A control trail crosses at least one of the safety trails or secondary safety trails and carries a control detonation wave which may sever the safety trail and thus prevent passage of the input detonation wave to the outlet trail and the primary charge of the weapon.

OBJECTS OF THE INVENTION

It is an object of the present invention to provide an explosive safety junction to meet the extremely high reliability and safety standards of conventional or nuclear weapons.

It is another object of the present invention to provide an explosive logic network which can provide high reliability and high safety while utilizing ordinary manufacturing techniques and standards.

It is a further object of the present invention to provide a safe arming device which does not require moving parts or a high current electrical supply.

It is a still further object of the present invention to provide a safe arming device which has increased reliability, increased storage life, less complexity, greater sealing integrity, and increased safety.

Other objects, advantages, and novel features of the present invention will become apparent from the following detailed description of the invention when considered in conjunction with the drawings.

BRIEF DESCRIPTION OF THE DRAWINGS

A more complete appreciation of the invention and many of the attendant advantages thereof will be readily understood by reference to the following detailed description when considered with the accompanying drawings in which like reference numerals designate like parts throughout the figures and wherein.

DESCRIPTION OF THE PREFERRED EMBODIMENT

Figure 1A:
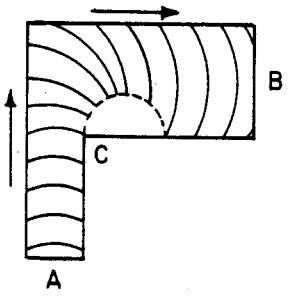
FIG. 1a PRIOR ART
FIGS. 1*a, b,* and *c* illustrate the corner effect in an explosive trail.
Figure 1B:
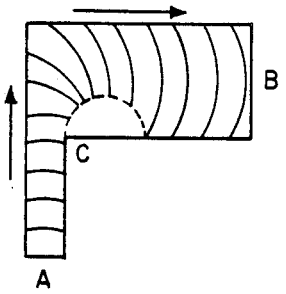
FIG. 1b PRIOR ART
Figure 1C:
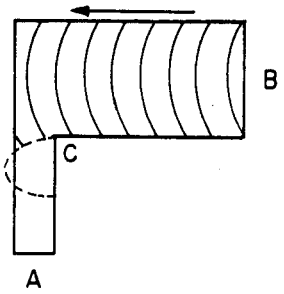
FIG. 1c PRIOR ART

Explosive logic networks for safe arming devices of conventional and nuclear weapons are based on the "corner effect" principle discovered by Denis Silvia and Richard Ramsey of the Naval Surface Weapons Center, Dahlgren, Va. The corner effect occurs when a detonation wave propagating in an explosive sheet or trail tries to turn a sharp corner. As illustrated in FIG. 1*a* and 1*b*, a detonation wave propagating from narrow trail A to wide trail B requires an increased width in trail B to negotiate corner C. As illustrated in FIG. 1*c*, a detonation wave propagating in an explosive trail from wide trail B to narrow trail A in negotiating corner C will turn wide around the corner and run out of room in the narrow explosive trail A and thus extinguish itself.

The principle of the corner effect can be used to establish an explosive diode or one way switch which in effect is the situation depicted in FIG. 1*c*. A detonation wave propagating from trail A will be able to turn the corner and proceed on to trail B but a detonation wave initiating in trail B will not be able to negotiate corner C, will extinguish itself, and will not propagate to trail A.

Figure 2A:
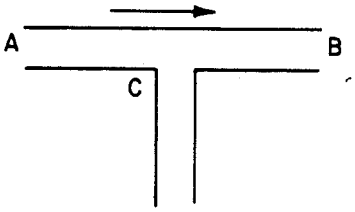
FIG. 2a PRIOR ART
FIGS. 2*a* and *b* illustrate the corner effect in a gate.
Figure 2B:
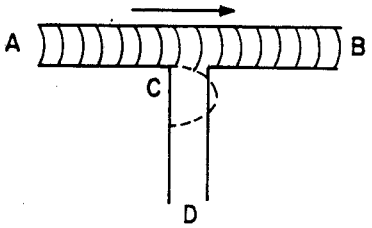
FIG. 2b PRIOR ART
Figure 3A:
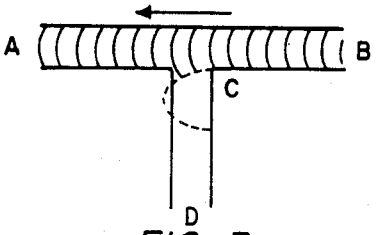
FIG. 3a PRIOR ART
FIGS. 3*a* and *b* illustrate the corner effect in a null gate.
Figure 3B:
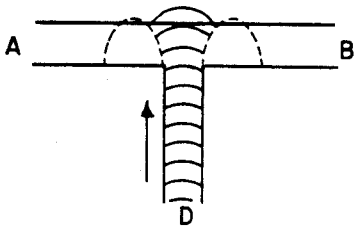
FIG. 3b PRIOR ART

As illustrated in FIGS. 2*a* and *b* and 3*a* and *b*, the corner effect can also be used to create a logic gate. FIGS. 2*a* and *b* illustrate a detonation wave propagating from trail A to trail B which, due to the corner effect, will not negotiate corner C and will not propagate down trail D. As illustrated in FIG. 3*a*, a detonation wave propagating from trail B to trail A will likewise not be able to negotiate corner C and thus will be prevented from propagating down leg or explosive trail D due to the corner effect. As shown in FIG. 3*b*, however, the detonation wave initiating in trail D will propagate to the intersection of trails A and B and will sever trails A and B and, again due to the corner effect, extinguish itself and not propagate down either trail A or trail B. The logic device described in FIG. 3*b* can be referred to as an explosive null gate. A detonation wave proceeding down trail D will disrupt trails A and B prior to a detonation wave passing along trails A and B and thus prevent passage of the detonation wave from trail A to trail B. In addition, the corner effect will prevent the detonation wave in trail D from turning into either trail A or trail B.

Figure 4:
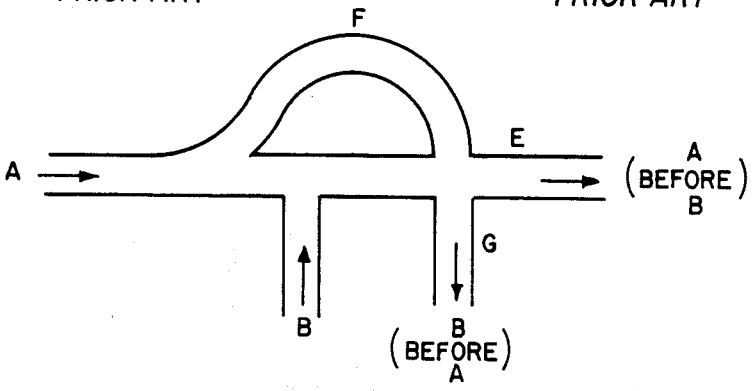
FIG. 4 PRIOR ART
FIG. 4 illustrates an explosive logic switch.

The principle of the corner effect, as embodied in the explosive logic null gate, can be utilized in an explosive logic switch device illustrated in FIG. 4. A detonation wave initiated in trail A prior to the initiation of a detonation wave in trail B (A before B) will result in the wave proceeding down trail A and into outlet trail E. However, if a detonation wave is initiated in trail B of FIG. 4 prior to the initiation of a detonation wave in trail A (B before A), then the detonation wave in trail B will sever trail A at the null gate thus preventing passage of the detonation wave down A to E. Instead, the detonation wave will proceed on explosive loop F, thus bypassing the severed null gate and proceed down outlet trail G. The detonation wave proceeding through loop F will proceed down trail G and not turn into trail E because of the corner effect. The incorporation of the corner effect, by means of the null gate in the explosive switch illustrated in FIG. 4, provides a logic switch for choosing between two possible sequences of events.

Figure 5A:
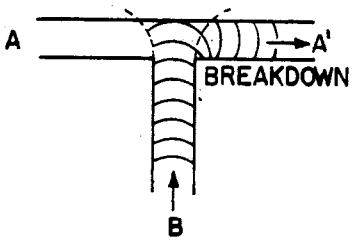
FIG. 5a PRIOR ART
FIGS. 5*a, b* and *c* illustrate the formation of a SYNTAX-AND-gate.

When the explosive logic devices of FIGS. 1 through 4 are incorporated into applications which require high reliability and safety, such as in conventional or nuclear weapon applications, a cause of major concern is that a breakdown in the corner effect phenomenon may lead to a reliability or safety failure. Such a breakdown is illustrated in FIG. 5A where a detonation wave propagating down trail B to the null gate of trails A and A′ instead of severing the trail A, A′ turns the corner and propagates down either trail A or trail A′. The breakdown of the corner effect could lead to an unanticipated sequence of events. The explosive safety junction of the subject invention defeats this problem while utilizing ordinary manufacturing standards in manufacturing the explosive logic networks and providing increased reliability and safety to safe arming devices.

Figure 5B:
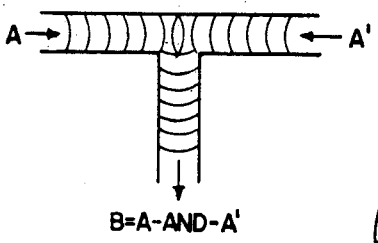
FIG. 5b PRIOR ART

Referring to FIG. 5*b*, there is illustrated the principle of the AND gate wherein instead of a single detonation propagating down the explosive trail from A to A′, detonations move in opposite directions toward each other from trail A and from trail A′. The detonation waves collide at the intersection of trails A and A′ with trail B. As a result of the energy generated by the collision, the corner effect is overcome and the detonation wave is propagated down trail B. The logic output of the device illustrated in FIG. 5*b* is a detonation wave propagated down trail B when opposing detonation waves are propagated down trails A and A′. The simultaneity requirements of the AND code negate its utility for timing the detonation of most explosive devices. Ordinary detonators differ in the time of their explosive output by many microseconds. This means that the location of the collision of the detonation waves propagating down trails A and A′ would not generally be in front of trail B thus preventing a detonation wave from propagating down trail B. The detonations supplied by separate detonators and sources outside of an explosive logic network are referred to as object signals.

Figure 5C:
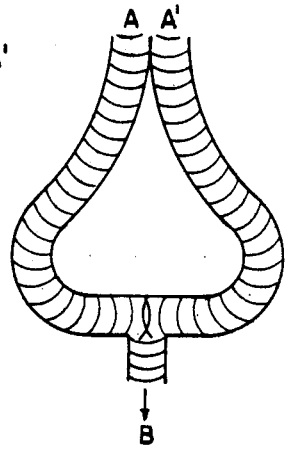
FIG. 5c PRIOR ART

As explained in the preceding paragraph, the AND gate is inadequate for resolving object signals, but is quite useful for resolving the signals in a SYNTAX-AND gate, illustrated in FIG. 5*c*. The SYNTAX-AND gate is formed by taking the AND gate of FIG. 5*b* and connecting the trails A and A′ at their opposed ends, as illustrated in FIG. 5*c*, so that the detonation wave initiated in trails A and A′ is from a single source and is initiated at the same time. The detonation wave or signal in trails A and A′ thus is initiated from a single point and only the difference in path length or explosive material properties can cause the lack of uniformity in the detonation wave timing. If the length of explosive trail A is equal to the length of explosive trail A′ then a detonation wave starting simultaneously at A and A′ will travel down each explosive trail and meet at the Junction of trails A and A′ with trail B. The detonation waves will collide at the junction with trail B and thus propagate an output detonation wave down trail B. If either trail A or trail A′ is severed, there will be no collision at the junction with trail B and thus no output detonation wave propagated down trail B.

Figure 6:
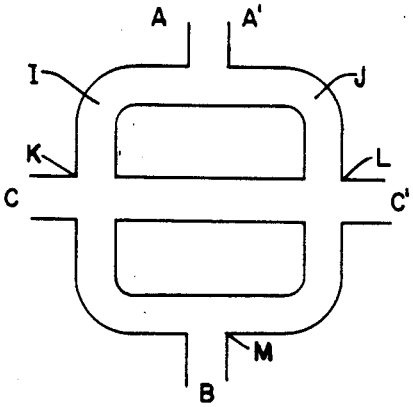
FIG. 6 illustrates the explosive safety junction of the subject invention.

Referring to FIG. 6, there is illustrated the explosive safety junction of the subject invention which incorporates the previously discussed principles of explosive logic to meet both the safety and reliability requirements placed on conventional and nuclear weapons. The safety junction is formed by using the SYNTAX-AND gate of FIG. 5*c* and providing it with a cross-over trail or control trail C to C′. As before, a detonation wave initiated at the inlet trail A-A′ will proceed into the diverging safety trails I and J which converge to form the outlet trail B. A control trail or cross-over trail C-C′ crosses the safety trails I and J. Due to the corner effect, the detonation wave propagating from inlet trail A-A′ down the safety trails I and J to the outlet trail B will not turn into the control trail C-C′.

Control trail C-C′ provides a control detonation wave which may sever safety trails I and J and thus prevent propagation of the detonation wave from A-A′ to outlet trail B. When the control detonation wave on control trail C-C′ reaches the safety trails I and J prior to the detonation wave from trail A-A′, the control detonation wave will sever the trails I and J and the detonation wave from A-A′ will never reach outlet trail B. It thus can be seen that the control trail C-C' acts as a simple gate to sever the safety trails I and J.

If, during the operation of the control trail, the corner effect phenomenon should break down or fail, causing the detonation wave from control trail C-C' to turn the corner and enter safety trail I or J, this could lead to the occurrence of an unanticipated sequence of logic events resulting in the detonation of the main charge.

Referring again to FIG. 6, if the corner illustrated as K fails during a control detonation along cross-over trail C-C', a detonation wave could enter safety trail I and be propagated either towards the inlet trail A-A' or towards the outlet trail B. If the detonation propagates toward the inlet trail A-A', the detonation will be required to proceed completely around the explosive safety Junction to arrive at outlet trail B. If the detonation wave propagates in the opposite direction it will proceed directly to outlet trail B. In either case, the detonation wave will arrive at the junction with outlet trail B and be required to negotiate the corner illustrated as M in FIG. 6. Ordinarily, the corner effect will prevent the unanticipated detonation wave from turning the corner M and proceeding down outlet trail B. However, if the corner effect again suffers a breakdown at M, a detonation wave would be propagated down outlet trail B as if a detonation wave had originated at inlet trail A-A'. For an inadvertent detonation wave to be propagated from the control or cross-over trail C-C' to the outlet trail B would require that the corner effect break down or fail at both corners K and M, an unlikely possibility.

If the corner illustrated as L in FIG. 6 should fail during a detonation along control trail C-C', the same sequence of events described in the previous paragraph would occur. For an inadvertent detonation wave to be propagated from control trail C-C' to outlet trail B, both corners L and M would have to suffer a breakdown in the corner effect.

If both the corners at K and L fail creating inadvertent detonation waves in both safety trails I and J there will not be a collision of the inadvertent detonation waves in front of outlet trail B such that an output detonation wave would be generated in outlet trail B because the corner at K will fail before the corner at L. Thus, if both corners K and L fail, there must still be a failure at corner M for a detonation wave to be propagated down the outlet trail.

Because the explosive safety junction illustrated in FIG. 6 requires that two successive corners or Junctions suffer a breakdown in the corner effect before an improper outlet detonation wave is generated at outlet trail B, the safety of the explosive safety Junction is higher than the safety of a simple gate. If a single corner has a 0.001 chance of failure then the simple gate has an identical chance of failure of 0.001. A safety junction, however, would have a probability of failure of $2\times(0.001)(0.001)$ chance of failing. Algebraically, if the probability of a corner failure is "u" then the probability of failure of a simple gate is also "u" while the probability of failure of the disclosed safety junction is $2u^2$.

Figure 7A:
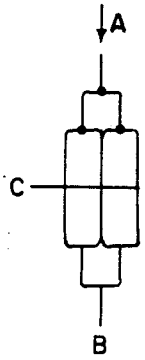
FIGS. 7, 7*a, b, c, d* and *e* illustrate additional embodiments of the explosive safety junction.
Figure 7B:
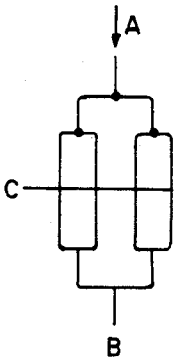
Figure 7C:
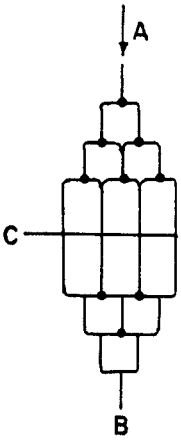
Figure 7D:
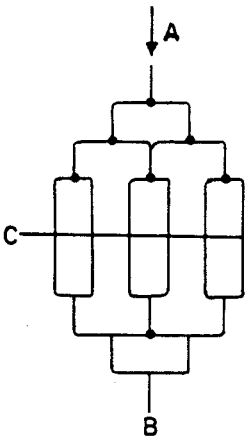
Figure 7E:
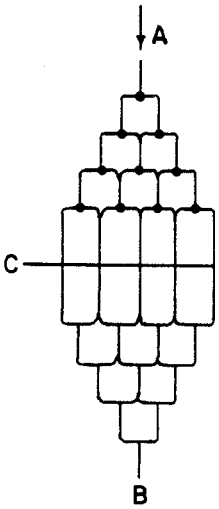

The explosive safety junction of FIG. 6 will meet the requirements of conventional weapon safing standards. Nuclear weapon standards are much higher and require that the safety junction be concatenated to form multi-tiers of safety trails with much smaller probabilities of failure. Referring to FIGS. 7*a, b, c, d,* and *e*, there are illustrated embodiments of the explosive safety junction having various multi-tiered safety trails which decrease the probability of failure of the junction. The degree of concatenation illustrated by the junctions in FIGS. 7*a* through *e* is unlimited. The lines of the junctions illustrated in FIGS. 7*a* through e represent explosive trails while the gates and switches are illustrated by the intersection of the lines. Whenever an intersection is wide enough so that the corner effect is not present, a solid dot is placed on the intersection indicating that the detonation will turn the corner. In calculating the safety values of various explosive safety junctions such as those illustrated in FIGS. 7*a* through *e*, it is helpful to adopt the following notation: let the following letters A, B, C, ... describe a junction. The first letter denotes the number of intersections crossing the control trail C-C', the second letter denotes the number of AND gates on one side connecting the intersections, the third letter denotes the number of intersections connecting the second letter AND gates, and so on, depending on the size of the safety Junction. Using this notation, Table I illustrates the gate, Figure, and safety value or probability of failure of the junction as a function of corner failure probability.

TABLE I

| FIG. | IDENTIFICATION | SAFETY $U = f(u)^{1,2}$ |
|---|---|---|
| 6 | 2,1 | $2u^2$ |
| 7a | 3,2,1 | $3u^3$ |
| 7b | 4,2,1 | $4u^3$ |
| 7c | 4,3,2,1 | $4u^4$ |
| 7d | 6,3,2,1 | $6u^4$ |
| 7e | 5,4,3,2,1 | $5u^5$ |

Thus if the corner failure rate is 0.001, to meet a nuclear safety standard of a failure rate of 1 in $1\times10^9$ it is required as a minimum that a 4,3,2,1 gate or safety junction be utilized. To meet a conventional weapons safety standard of $1\times10^6$ requires a 4,2,1 or 3,2,1 gate or safety junction be utilized.

Figure 8A:
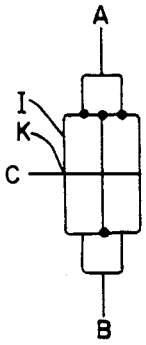
FIGS. 8*a, b, c* and *d* illustrate still further embodiments of the explosive safety junction.
Figure 8B:
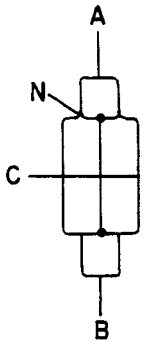
Figure 8C:
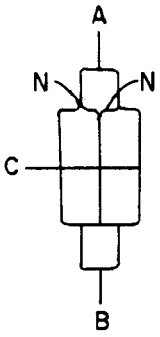
Figure 8D:
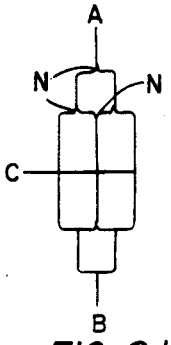

Referring now to FIGS. 8*a* through *d* there is illustrated a variation of the explosive safety Junction previously disclosed. In FIG. 8*a*, if the corner effect should break down at corner K the detonation wave from control trail C-C' can proceed in one or both directions on safety trail I. As previously discussed, the breakdown can initiate a detonation wave in safety trail I in either direction. The breakdown could initiate the detonation wave towards the inlet trail A which would require that the detonation wave travel around the safety junction to arrive at the outlet trail B. Conversely, the detonation wave could also proceed directly to outlet trail B. As illustrated in FIGS. 8*b, c* and *d* the tiers of safety trails may be shaped in such a way, as indicated at N in FIG. 8*b*, to prevent the inadvertent detonation wave from traveling around the safety junction and proceeding to outlet trail B. The junction N may be curved so as to prevent the detonation wave generated by the control trail C from proceeding around the junction by diverging or directing the inadvertent detonation wave into the inlet trail A. FIGS. 8*c* and 8*d* further illustrate the method of directing the inadvertent detonation wave into the inlet trail.

Figure 9A:
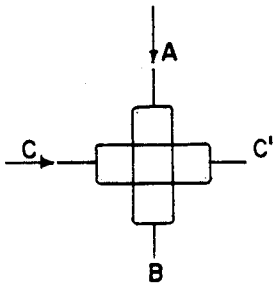
FIGS. 9*a* and *b* illustrate embodiments of the explosive safety junction with variations in the control trail.
Figure 9B:
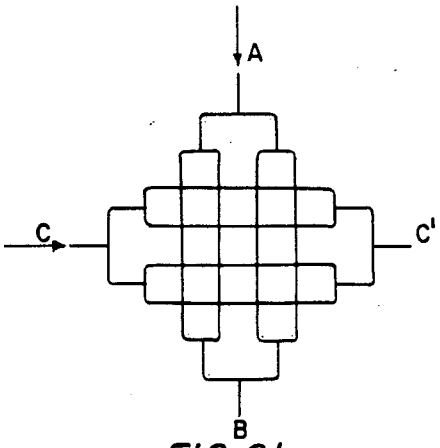

Referring to FIGS. 9*a* and 9*b*, there is illustrated a further variation which may be incorporated into the explosive safety junction. This variation also provides for the elimination of cross talk between the control trail C-C' and the safety trails which results in an inadvertent detonation wave at outlet trail B. As illustrated in FIGS. 9*a* and 9*b*, control trail C-C' is provided with diverging secondary control trails which prevent inadvertent detonation waves from being generated in control trail C-C' by the breakdown of the corner effect when a detonation wave is propagated from inlet trail A to outlet trail B severing control trail C-C'. The diverging and secondary control trails of FIG. 9*a* and 9*b* can be concatenated as desired to decrease the probability of a detonation wave being inadvertently propagated in the control trail.

Figure 10:
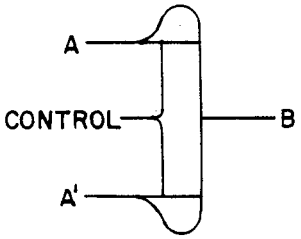
FIG. 10 illustrates an alternative embodiment of the explosive safety junction.
Figure 11A:
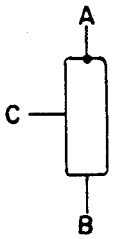
FIGS. 11*a, b, c, d, e* and *f* illustrate embodiments of the explosive safety junction with partial crossover trails.
Figure 11B:
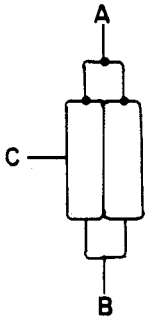
Figure 11C:
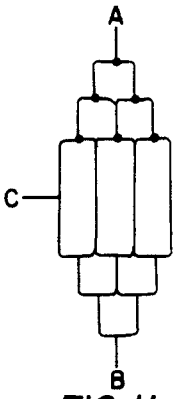
Figure 11D:
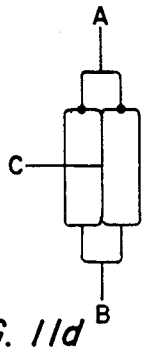
Figure 11E:
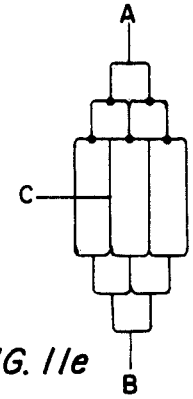
Figure 11F:
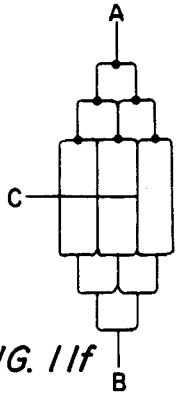

FIG. 10 illustrates a further variation for a safety explosive junction having a probability of corner failure of $2u^2$. Because of the path length of the junction illustrated in FIG. 10, the reliability of the AND gate for generating a detonation wave in outlet trail B would be questionable.

FIGS. 11*a* through *f* illustrate embodiments of the explosive safety junction that can be used when a full cross-over or control trail is not necessary. The safety Junctions of FIGS. 11 through f utilize partial control trails and expose fewer corners to potential failure of the corner effect and thus decrease the probability of failure of the safety junctions. Table II illustrates a Probability of failure of the safety junction as a function of corner failure probability for the explosive safety junctions illustrated in FIGS. 11*a* through *f*.

TABLE II

| FIG. | IDENTIFICATION | APPROXIMATE SAFETY (FOR A SINGLE = u) |
|---|---|---|
| 11a | 1,1 | $u^2$ |
| 11b | 1,1,1 | $2u^3$ |
| 11c | 1,1,1,1 | $3u^4$ |
| 11d | 2,2,1 | $2u^3$ |
| 11e | 2,3,2,1 | $5u^4$ |
| 11f | 3,3,2,1 | $7u^4$ |

Any level of concatenation can be achieved with the explosive safety junctions having partial cross-over or control trails just as with the full cross-overs illustrated previously. The choice between a full or partial cross-over safety junction is determined by the trade off between the safety and reliability desired for a particular application.

It is thus apparent that the disclosed explosive safety junction provides a logic network which will meet the extremely high reliability and safety standards of conventional and nuclear weapons while utilizing standard manufacturing techniques and manufacturing tolerances. The safety junction provides greater reliability, longer storage life, less complexity, greater sealing integrity, and requires no expensive power supply or moving mechanical parts.

Many obvious modifications and embodiments of the specific invention other than those set forth above will readily come to mind to one skilled in the art having the benefit of the teachings presented in the foregoing description and the accompanying drawings of the sub-Ject invention and hence it is to be understood that such modifications are included within the scope of the appended claims.

I claim:

1. A device for increasing the reliability and safety of an explosive trail, comprising:

an inlet trail;

an outlet trail;

a control trail; and safety junction means connecting the inlet trail, outlet trail and control trail such that the probability of a false detonating signal being propagated in the outlet trail from the control trail is reduced.

2. The device as in claim 1 wherein the safety junction means is a divergence in the inlet trail to form two or more safety trails, said safety trails converging to form the outlet trail.

3. The device as in claim 2 wherein the control trail crosses at least one of the safety trails.

4. The device as in claim 2 wherein the control trail terminates at one of the safety trails to form a gate.

5. The device as in claim 1 wherein the safety junction means is a divergence in the inlet trail to form two safety trails, said safety trails further diverging to form at lest one tier of diverging trails, said at least one tier of trails converging to form the safety trails, said safety trails converging to form the outlet trail.

6. The device as in claim 5 wherein the control trail crosses the diverging trails.

7. The device as in claim 5 wherein the control trail crosses at least one of the diverging trails.

8. The device as in claim 5 wherein the control trail terminates at one of the diverging trails to form a gate.

9. The device as in claims 2 or 5 wherein the control trail diverges to form at least one tier of secondary control trails.

10. The device as in claim 5 wherein the safety trails diverge to form multiple tiers of trails, said trails being parallel and converging to reform the safety trails.

11. The device as in claims 2, 5 or 10 wherein the diverging and converging trails are shaped to prevent reverse propagation from the control trail to the outlet trail.

12. The device as in claim 10 wherein the parallel trails within a tier are connected.

13. The device as in claim 10 wherein the parallel trails within a tier overlap.

14. The device as in claim 10 wherein the control trail crosses one of the multiple tiers.

15. The device as in claim 14 wherein the control trail diverges to form at least one tier of secondary control trails.

16. A device for increasing the reliability and safety of an explosive trail, comprising:

an inlet trail;

an outlet trail;

a control trail; and safety junction means connecting the inlet trail, outlet trail and control trail such that the probability of a false detonation signal being propagated in the outlet trail from the control trail is reduced, said safety junction means being a divergence in the inlet trail to form two or more safety trails of equal length, said safety trails further diverging to form at least one tier of diverging trails with the diverging trails within a tier being of equal length, said at least one tier of diverging trails converging to reform the safety trails, said safety trails converging to reform the outlet trail.

17. The device as in claim 16 wherein the control trail crosses at least one of the diverging trails.

* * * * *